United States Patent [19]

Krueger et al.

[11] 4,415,516

[45] Nov. 15, 1983

[54] METHOD AND APPARATUS FOR MAKING ALIGNED FLAKE COMPOSITE WOOD MATERIAL INCLUDING INTEGRAL BAFFLES

[75] Inventors: Gordon P. Krueger, Hancock; Anders E. Lund, Houghton, both of Mich.

[73] Assignee: Board of Control of Michigan Technological University, Houghton, Mich.

[21] Appl. No.: 365,634

[22] Filed: Apr. 5, 1982

[51] Int. Cl.[3] ..... D04M 1/16

[52] U.S. Cl. ..... 264/112; 264/113; 425/117; 425/125; 249/84; 249/93

[58] Field of Search ..... 264/112, 113; 425/117, 425/125; 249/84, 93

[56] References Cited

U.S. PATENT DOCUMENTS

| | | | |
|---|---|---|---|
| 3,202,743 | 8/1965 | Elmendorf | 264/109 |
| 3,478,861 | 11/1969 | Elmendorf | 198/33 |
| 3,721,329 | 3/1973 | Turner et al. | 198/33 |
| 3,963,400 | 6/1976 | Urmanov | 425/224 |
| 4,241,133 | 12/1980 | Lund et al. | 428/326 |

*Primary Examiner*—James R. Hall

[57] ABSTRACT

A method and apparatus for forming a loosely felted mat of elongated wood flakes mixed with a binder, the mat including a longitudinal axis and the wood flakes being aligned in mutually parallel relation and parallel to the longitudinal axis of the mat. The wood flakes are held in alignment in the mat by a plurality of closely spaced thin planar baffles, the baffles being comprised of a material which can form an integral part of the mat.

12 Claims, 4 Drawing Figures

METHOD AND APPARATUS FOR MAKING ALIGNED FLAKE COMPOSITE WOOD MATERIAL INCLUDING INTEGRAL BAFFLES

FIELD OF THE INVENTION

The present invention relates to the production of composite wood or compressed wood particle products and to methods and apparatus for forming a mat of wood particles to be compressed.

BACKGROUND PRIOR ART

As set forth in the U.S. Lund et al. U.S. Pat. No. 4,241,133, issued Dec. 23, 1980 and assigned to the assignee of the present invention, it has been found to be desirable in the construction of compressed or composite wood particle products to employ wood flakes which are very thin and which have a length at least several times their width and to align the wood flakes in mutually parallel alignment and in alignment with the longitudinal axis of the product being produced. This produces a product having substantially improved strength characteristics in the direction of alignment of the wood flakes. The production of such compressed wood products formed from an assembly of wood particles first requires the formation of a loosely felted mat of wood particles. The mat is then compressed to form a densified panel or board. One problem encountered in forming the loosely felted mat is that the alignment or orientation of the elongated wood flakes is made difficult because the wood flakes, which are very light and comparatively fragile, have to be handled en masse, and this has resulted in the clogging of the known machines that were tried for this purpose. Additionally, it has been difficult to produce mats of uniform thickness using prior art machines. Another problem in connection with handling and orienting the wood flakes has been that the flakes tend to be randomly oriented as they fall onto the mat and must be held in alignment as they are deposited.

Examples of prior art attempts to design suitable apparatus for forming mats of aligned wood strands are set forth in Elmendorf U.S. Pat. No. 3,478,861, issued Nov. 18, 1969; the Elmendorf U.S. Pat. No. 3,220,743, issued Aug. 24, 1965; the Turner et al. U.S. Pat. No. 3,721,329, issued Mar. 30, 1973; the Urmanov U.S. Pat. No. 3,963,400, issued June 15, 1976; and Canadian Pat. No. 597,941, issued May 10, 1960.

Attention is also directed to the Hostettler U.S. Pat. No. 3,226,764, issued June 4, 1966; and Hostettler U.S. Pat. No. 3,070,838, issued Jan. 1, 1963; the Carlsson et al. U.S. Pat. No. 3,692,612; the Paerels et al. U.S. Pat. No. 3,372,217, issued Mar. 5, 1968; the Axer et al. U.S. Pat. No. 3,824,058, issued July 16, 1974; and the Chapman U.S. Pat. No. 2,992,152, issued July 11, 1961.

SUMMARY OF THE INVENTION

The invention includes a method and apparatus for forming a mat of wood particles mixed with a binder, the mat being adapted to be compressed to form a high density composite wood product. More specifically, the invention includes a method and apparatus for forming a mat wherein the wood particles comprise wood flakes, these wood flakes being elongated and being aligned in mutually parallel relationship and in parallel relation to the longitudinal axis of the mat being formed. The method and apparatus of the invention are intended to provide a mat of wood flakes which can be compressed so as to form a product as described in Lund et al. U.S. Pat. No. 4,241,133, referred to above.

More particularly, the invention includes an apparatus for forming a loosely felted mat of elongated wood flakes, the mat including a longitudinal axis and the wood flakes being aligned in mutually parallel relation and parallel to the longitudinal axis of the mat. The apparatus comprises a caul plate adapted to support wood flakes and sidewalls extending vertically upwardly from the sides of the caul plate and for restraining wood flakes deposited on the caul plate. The apparatus also includes means for causing elongated wood flakes being deposited on the caul plate to be aligned in mutually parallel relation and parallel to the sidewalls and to maintain the elongated wood flakes in such parallel relation as additional flakes are deposited and as the caul is removed to a press. The means for aligning includes a plurality of baffles supported in closely spaced mutually parallel relation between the sidewalls, the baffles defining parallel vertical planes parallel to the sidewalls, and the baffles being adapted to form a portion of the loosely felted mat and to be removed with the mat when the caul is removed to a press. The apparatus further includes means for releasably supporting the opposite ends of the baffles.

In one embodiment of the invention, the means for releasably supporting the opposite ends of the baffles includes a first set of vertically extending rods extending upwardly adjacent one end of the caul plate, the rods of the first set of rods being mutually spaced apart and defining a plane generally parallel to one end of the caul plate. Also included is a second set of rods extending upwardly adjacent an opposite end of the caul plate, the rods of the second set also being spaced apart and defining a plane generally perpendicular to the baffles.

In one embodiment of the invention the baffles are comprised of material adapted to form an integral part of the loosely felted mat.

In one embodiment of the invention, the baffles are comprised of a continuous length of material reeved around the vertically extending rods, this material extending around at least a portion of a rod of the first set, along the length of the caul plate and around at least a portion of a rod of the second set.

The invention also includes a method for forming a loosely felted mat of elongated wood flakes, the mat having a longitudinal axis and the wood flakes being aligned in mutually parallel relation and parallel to the longitudinal axis of the mat. The method comprises the steps of providing an elongated base member having an elongated upper planar surface, the surface having opposite ends, providing sidewalls extending vertically upwardly from the sides of the base member, the sides being adapted to restrain wood flakes positioned on the base, and positioning a caul plate on the planar surface for supporting wood flakes thereon, the caul plate being removable from the supporting surface. The method also includes the steps of positioning baffles between the sidewalls such that the baffles are positioned in mutually parallel spaced equidistant relation between the sidewalls and define planes parallel to the sidewalls, the baffles each having a lower edge positioned adjacent the caul plate, and depositing elongated wood flakes between the baffles to form a loosely felted mat, the baffles causing the flakes to assume mutually parallel alignment and an alignment parallel to the planes of the baffles.

In one embodiment of the invention, the wood flakes have a grain direction extending generally parallel to the longitudinal axis thereof, an average length of about 0.5 to about 3.5 inches, an average length to average width ratio of about 4:1 to about 10:1 and an average thickness of about 0.01 to about 0.05 inches.

Various other features and advantages of the invention are set forth in the following description of a preferred embodiment, in the claims and in the drawings.

Figure 1:
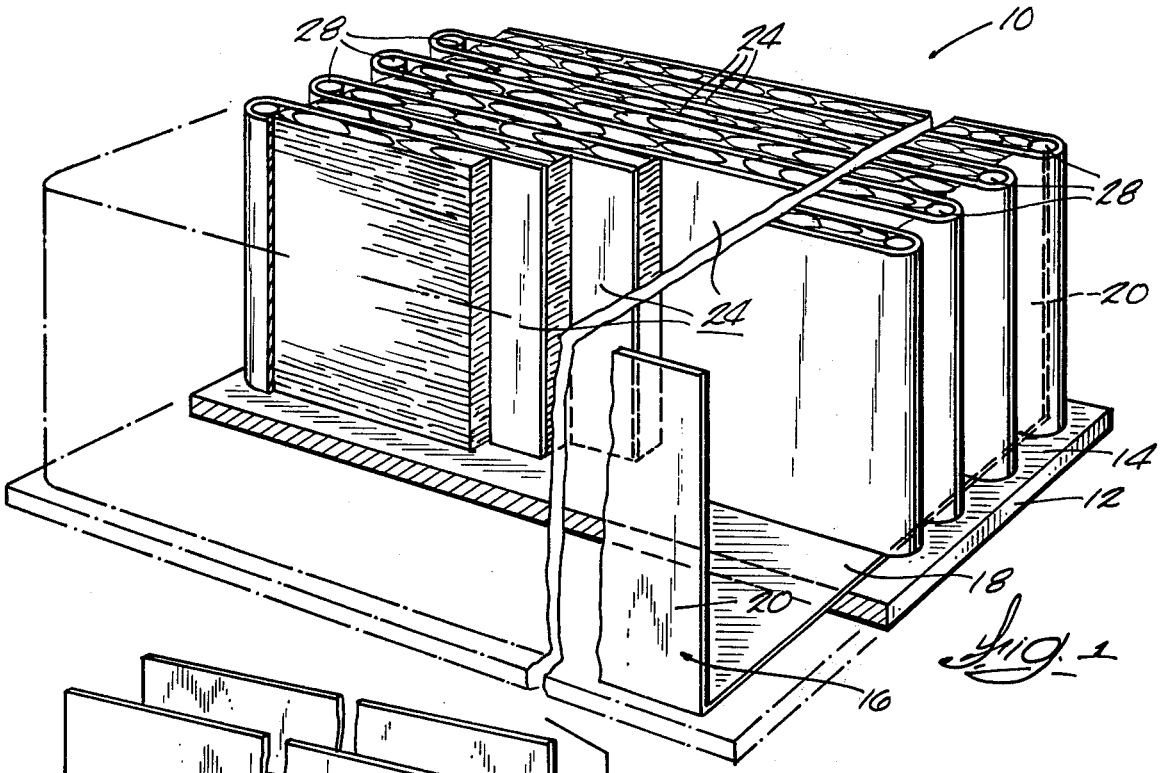
FIG. 1 is a perspective view of apparatus embodying the present invention and for forming a loosely felted mat of aligned wood flakes.
Figure 2:
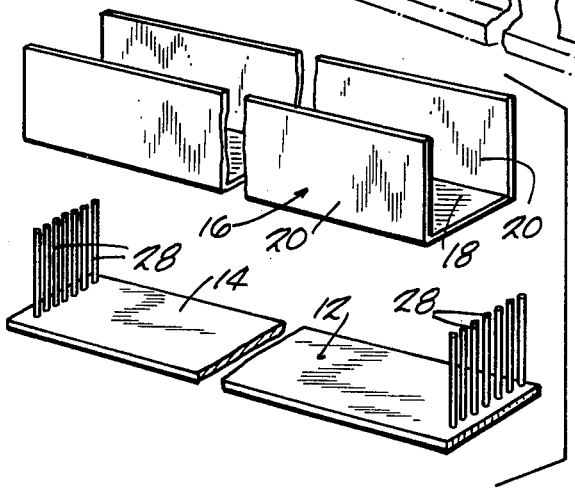
FIG. 2 is an exploded view of the apparatus shown in FIG. 1.
Figure 3:
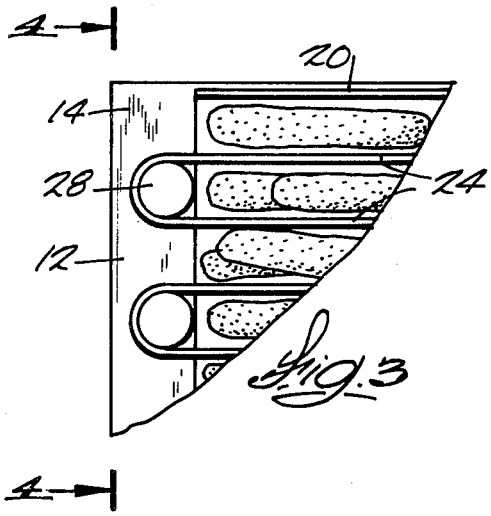
FIG. 3 is an enlarged partial plan view of the apparatus shown in FIG. 1.
Figure 4:
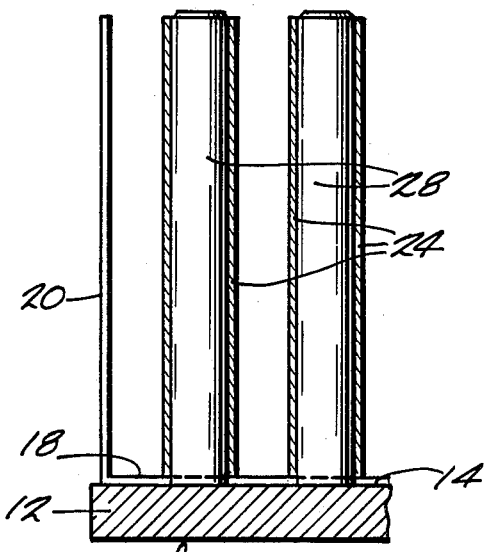
FIG. 4 is a cross section view taken along line 4—4 in FIG. 3.

Before describing a preferred embodiment of the invention in detail, it is to be understood that the invention is not limited in its application to the details of construction nor to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in FIG. 1 is an apparatus for forming a loosely felted mat 10 comprised of wood flakes and a binder, this mat 10 being adapted to be placed in a press and to be compressed therein to form a densified composite wood product such as is illustrated, for purposes of example, in the Lund et al. U.S. Pat. No. 4,421,133. One feature of the apparatus of the invention is that it provides convenient means to facilitate alignment of the wood flakes such that they are positioned with their longitudinal axes in mutually parallel relation and parallel to the longitudinal axis of the mat.

Referring more particularly to the apparatus illustrated in FIG. 1, it includes a base member 12 having a generally flat elongated planar upper supporting surface 14, the base member 12 being adapted to be supported or positioned with this upper surface 14 forming a horizontal plane. The base member includes elongated sides and opposite ends.

The apparatus also includes means for retaining wood flakes which are deposited or dropped onto the base member 12. In the illustrated arrangement this means for retaining the wood flakes includes a U-shaped elongated containment box 16 adapted to be positioned on the upper surface 14 of the base member. The U-shaped containment box 16 includes a planar floor or caul plate 18 adapted to rest on the upper surface 14 of the base member 12. The caul plate 18 has a width approximating that of the upper surface of the base member and the length of the caul plate is slightly less than the length of the upper surface 14.

The U-shaped containment box 16 also includes vertical sidewalls 20 which extend upwardly from the elongated sides of the caul plate 18, the sidewalls 20 having a height approximating that of the thickness of the loosely felted mat which is to be formed using the apparatus of the invention. The opposite ends of the U-shaped containment box are open, and the box is open at the top.

While in the illustrated arrangement, the side walls 20 are integrally joined to the floor or caul plate 18, in other arrangements, the sidewalls 20 could be supported in other ways. For example, the sidewalls could be integrally joined to the sides of the base member 12.

In operation of the apparatus of the invention, the containment box 16 is adapted to receive a furnish comprised of a mixture of wood flakes and a binder material, the furnish being deposited or dropped into the containment box. As is set forth in the U.S. Lund et al. patent referred to above, in the construction of an elongated product comprised of wood flakes, it is preferred that the flakes be oriented in the loosely felted mat in mutually parallel relation and in parallel relation to the longitudinal axis of the product to be formed. Additionally, for best results it is preferred that the wood flakes of the furnish should have an average length of about 0.5 inch to about 3.5 inches, and preferably about 1 inch to about 2 inches, and an average thickness of about 0.01 to about 0.05 inch, preferably about 0.015 to about 0.025 inch and most preferably about 0.02 inch. Flakes longer than about 3.5 inches tend to curl, and this hinders proper alignment of the flakes during the formation of a mat. It is also difficult to insure that flakes shorter than about 0.5 inch do not become aligned with their grain direction crosswise. Flakes thinner than about 0.01 inch tend to require excessive amounts of binder to be mixed with these flakes if an adequate bonding of the flakes is to occur. Flakes thicker than about 0.05 inch are relatively stiff and tend to require excessive compression to obtain a desired intimate contact therebetween. In any given batch, some of the flakes can be shorter than 0.5 inch and some can be longer than 3.5 inches so long as the overall average length of the flakes is within the above range. The same is true for the thickness. To facilitate proper alignment of the flakes, it is preferred that the flakes should have a length which is several times the width, preferably about 4 to about 10 times. Using this constraint as a guide, the average width of the flakes generally should be about 0.1 to 0.5 inches.

The furnish is formed by introducing flakes of the size that is described above into a conventional blender wherein predetermined amounts of a binder are applied to the flakes as they are tumbled or agitated in the blender. Suitable binders include those used in the manufacture of particleboard and similar pressed particle products. Such binders may include organic polyisocyanates including those curable at room temperature or urea formaldehyde.

The apparatus of the invention further includes means for causing flakes having a geometry as defined above to be deposited in the containment box 16 and to be oriented therin in mutually aligned relation with substantially all of the flakes being oriented in alignment parallel to the longitudinal axis of the containment box, i.e. parallel to the sidewalls 20 of the containment box. This means for alignment includes a plurality of baffles 24 which are positioned in closely spaced mutually parallel relation, the baffles 24 being parallel to the sidewalls 20 and being spaced apart across the width of the caul plate 18. In preferred forms of the invention, the material forming the baffles 24 can comprise a continuous length of material such as paper, latent resin-coated paper, fiberglass fibers, an uncurred resin carrier, a wire sheet, cheesecloth, or latent adhesive bonding film. If the baffle sheet were comprised of an adhesive film, that film could be urea, resorcinol, phenolic, epoxy, polyester, or some other synthetic material. It should be noted that, for convenience of illustration, the drawings shown the baffle material as having an exaggerated thickness whereas in practice, very thin materials are preferred.

In the illustrated construction, the baffles 24 are formed by threading this continuous length of material back and forth along the length of the containment box 16 with the baffle material extending around a plurality of vertically positioned rods 28 supported by the opposite ends of the base member 12. In the illustrated construction the base member 12 is somewhat longer than the composite wood mat to be formed in order to accommodate or provide means for supporting these vertically extending rods 28. The rods are aligned along the opposite ends of the base member and define planes substantially perpendicular to the longitudinal axis of the base. The rods 28 are positioned in closely spaced equidistant relation, and in a preferred form of the invention the spacing may be 0.25 to 1.0 inch depending upon the widths of the flakes.

The continuous length of baffle material is reeved around these rods 28 and back and forth along the length of the base 12 with the baffles 24 being spaced apart by a distance somewhat greater than the width of the flakes to be deposited on the caul plate. It should be noted that the vertical rods 28 have a height approximating that of the sidewalls 20 of the containment box 16, and the baffle material similarly has a height such that the upper edges of the baffles 24 are adjacent the upper edges of the sidewalls.

The materials referred to above as examples of the materials for use in forming the baffles 24 are selected as suitable materials which can become an integral part of the loosely felted mat formed by the apparatus of the invention. In operation of this apparatus, the containment box 16 is first placed on the of the base member 12 with the caul plate 18 resting on the upper surface 14. The continuous length of baffle material is then reeved back and forth along the length of the containment box 16 and around the elongated rods 28 so as to assume the position as shown in FIG. 1 and so as to form a plurality of baffles 24 in spaced apart relation between the sidewalls of the containment box 16. The flake material, mixed with binder, is then deposited in the containment box 16. As they fall through the ambient air, the flakes will assume a horizontal position. The flakes so deposited will thus build up as a loosely felted mat and with the wood flakes being aligned by the baffles 24 in generally parallel relation and with their longitudinal axes substantially parallel to the longitudinal axis of the mat being formed.

When a mat having the desired thickness has been formed, the containment box 16 is then pulled upwardly away from the base member 12 thereby stripping the baffle material upwardly off of the vertically extending rods 28, and the baffle material becomes an integral part of the loosely felted mat. The containment box 16 can then be placed in a press wherein the loosely felted mat is compressed under substantial pressures so as to form a densified composite wood product. The formation of another loosely felted mat requires placement of a containment box 16 on the base 12 and reeving of baffle material back and forth over the vertically extending rods 28 to once again form baffles between the sidewalls of the containment box.

In the illustrated arrangement, the spacing of the baffles 24 is provided so as to accept wood flakes having dimensions as identified above. This spacing is achieved by selection of steel rods 28 having a diameter generally equal to the desired spacing between the baffles and by spacing the rods at a distance substantially equal to the diameter of the vertical rods, i.e. with the spacing between the longitudinal axes of the respective rods 28 being twice the diameter of the rods.

Various features of the invention are set forth in the following claims.

We claim:

1. An apparatus for forming a loosely felted mat of elongated wood flakes, the mat including a longitudinal axis and the wood flakes being aligned in mutually parallel relation and parallel to the longitudinal axis of the mat, the apparatus comprising:

means defining a caul plate adapted to support wood flakes thereon, said caul plate having spaced apart elongated sides, means for restraining wood flakes deposited on said caul plate, said restraining means including sidewalls extending vertically upwardly from said sides, means for causing elongated wood flakes being deposited on said caul plate to be aligned in mutually parallel relation and parallel to said side walls and to maintain said elongated wood flakes in such parallel relation as additional flakes are deposited and as said caul is moved to a press, said means for aligning including a plurality of baffles supported in closely spaced mutually parallel relation between said sidewalls, said baffles defining parallel vertical planes parallel to said sidewalls, and said baffles being adapted to form a portion of the loosely felted mat and to be removed with the mat when the caul is removed to a press, and means for releasably supporting said opposite ends of said baffles.

2. An apparatus as set forth in claim 1 wherein said baffles are comprised of material adapted to form an integral part of said loosely felted mat.

3. An apparatus as set forth in claim 1 wherein said means for releasably supporting said opposite ends of said baffles includes two sets of rods, said sets including a first set of vertically extending rods extending upwardly adjacent one end of said caul plate, said rods of said first set being mutually spaced apart and defining and plane generally parallel to said one end of said caul plate, and a second set of rods extending upwardly adjacent an opposite end of said caul plate, said rods of said second set being spaced apart and defining a plane generally perpendicular to said baffles.

4. An apparatus as set forth in claim 3 wherein said baffles are comprised of a continuous length of material reeved around said vertically extending rods, said material extending around at least a portion of a rod of said first set, along the length of said caul plate and around at least a portion of a rod of said second set.

5. An apparatus as set forth in claim 1 wherein said caul plate and said sidewalls are integrally joined together.

6. An apparatus as set forth in claim 1 wherein said baffles are spaced one from another in equidistant relation.

7. An apparatus as set forth in claim 1 wherein said baffles each comprise a thin substrate and wherein said baffles include a lower edge positioned adjacent said caul plate and an upper edge having a height approximately the same as that of the upper edge of said sidewalls.

8. A method for forming a loosely felted mat of elongated wood flakes, the mat having a longitudinal axis and the wood flakes being aligned in mutually parallel relation and parallel to the longitudinal axis of the mat, the method comprising:

providing a caul plate adapted to support wood flakes thereon, said caul plate having spaced apart elongated sides, providing sidewalls extending vertically upwardly from the sides of the caul plate, the sidewalls being spaced apart and defining generally parallel planes and being adapted to restrain wood flakes positioned on the caul plate, positioning baffles between said sidewalls such that said baffles are positioned in mutually parallel spaced equidistant relation between said sidewalls and define planes parallel to said sidewalls, said baffles each having a lower edge positioned adjacent said caul plate and an upper edge, and depositing elongated wood flakes between said baffles to form a loosely felted mat, said baffles causing said flakes to assume mutually parallel alignment and an alignment parallel to said planes of said baffles.

9. A method as set forth in claim 8 wherein said wood flakes have a grain direction extending generally parallel to the longitudinal axis thereof, an average length of about 0.5 to about 3.5 inches, an average length to average width ratio of about 4:1 to about 10:1 and an average thickness of about 0.01 to about 0.05 inches.

10. A method as set forth in claim 8 wherein said baffles are comprised of a continuous length of a thin substrate and wherein said baffles are positioned between said sidewalls by reeving said baffles over elongated rods extending vertically upwardly adjacent opposite ends of said caul plate, said rods being mutually spaced apart in a direction perpendicular to the planes defined by the baffles.

11. A method as set forth in claim 8 and wherein said baffles form an integral part of said loosely felted mat.

12. A method as set forth in claim 8 and wherein said wood flakes are planar and wherein said wood flakes are deposited such that said wood flakes in the loosely felted mat lie in horizontal planes.

* * * * *

UNITED STATES PATENT AND TRADEMARK OFFICE

CERTIFICATE OF CORRECTION

PATENT NO. : 4,415,516

DATED : November 15, 1983

INVENTOR(S) : Gordon P. Krueger, Anders E. Lund, Roy D. Adams

It is certified that error appears in the above—identified patent and that said Letters Patent is hereby corrected as shown below:

Page 1, in the Inventors, line 2, delete "both" and substitute --Roy D. Adams, Houghton, all--

Signed and Sealed this

*Twenty-fourth* Day of *April 1984*

[SEAL]

*Attest:*

GERALD J. MOSSINGHOFF

*Attesting Officer*

*Commissioner of Patents and Trademarks*